US012538986B2

(12) United States Patent
Alletto, Jr. et al.

(10) Patent No.: US 12,538,986 B2
(45) Date of Patent: Feb. 3, 2026

(54) BEDDING SYSTEM AND METHOD

(71) Applicant: BEDGEAR, LLC, Farmingdale, NY (US)

(72) Inventors: Eugene Alletto, Jr., Glen Head, NY (US); Lorenzo Turicchia, Arlington, MA (US)

(73) Assignee: Bedgear, LLC, Farmingdale, NY (US)

( * ) Notice: Subject to any disclaimer, the term of this patent is extended or adjusted under 35 U.S.C. 154(b) by 314 days.

(21) Appl. No.: 16/520,765

(22) Filed: Jul. 24, 2019

(65) Prior Publication Data

US 2020/0029702 A1 Jan. 30, 2020

Related U.S. Application Data

(60) Provisional application No. 62/703,990, filed on Jul. 27, 2018.

(51) Int. Cl.
*A47C 21/04* (2006.01)
*A47C 17/86* (2006.01)

(52) U.S. Cl.
CPC ..... *A47C 21/044* (2013.01); *A47C 17/86* (2013.01)

(58) Field of Classification Search
CPC ..... A47C 7/75; A47C 21/044; A47C 20/04; A47C 27/007; A47C 7/74; A47C 17/86; A47G 9/1036; A61G 7/05784
See application file for complete search history.

(56) References Cited

U.S. PATENT DOCUMENTS 3,290,703 A * 12/1966 Worrall ..... A47G 9/0253 5/490
4,706,313 A 11/1987 Murphy
4,946,220 A * 8/1990 Wyon ..... A47C 7/74 297/180.13
5,109,560 A 5/1992 Uetake
6,691,355 B1 2/2004 Liu
7,914,611 B2 * 3/2011 Vrzalik ..... A61G 7/05715 96/11
8,191,187 B2 6/2012 Brykalski et al.
8,745,784 B2 6/2014 Cole et al.
8,806,678 B2 8/2014 Michael
9,072,639 B2 * 7/2015 Essers ..... A47C 27/15
9,265,352 B2 2/2016 Oakhill et al.
9,463,124 B2 * 10/2016 Lachenbruch ..... A61G 7/001
9,596,946 B2 3/2017 Scarleski et al.
9,635,954 B2 5/2017 Scarleski et al.
9,756,952 B2 9/2017 Alletto, Jr. et al.
(Continued)

FOREIGN PATENT DOCUMENTS

JP 2006076398 A * 3/2006 ..... B60N 2/5692
KR 101610730 B1 * 4/2016 ..... A47C 7/74
WO 2014072752 A1 5/2014

*Primary Examiner* — Justin C Mikowski
*Assistant Examiner* — Amanda L Bailey
(74) *Attorney, Agent, or Firm* — Sorell, Lenna & Schmidt, LLP

(57) ABSTRACT

A bedding system includes a mattress having a sleep surface including a plurality of air transfer ports. An encasement encloses the sleep surface. The encasement includes an air flow port. The air flow port is configured to be coupled to a pressure generator so that air drawn into the pressure generator is pulled into the air transfer ports or air that is forced into the encasement is forced out of the air transfer ports.

14 Claims, 11 Drawing Sheets

(56) References Cited

U.S. PATENT DOCUMENTS

| | | | | |
|---|---|---|---|---|
| 9,820,581 | B2 | 11/2017 | Alletto et al. | |
| 2002/0129449 | A1* | 9/2002 | Harker | A61G 7/05784 5/423 |
| 2003/0019044 | A1* | 1/2003 | Larsson | A47C 31/007 5/724 |
| 2007/0245493 | A1* | 10/2007 | Leifermann | A47G 9/0253 5/636 |
| 2008/0028536 | A1 | 2/2008 | Hadden-Cook | |
| 2009/0241264 | A1* | 10/2009 | Bensoussan | A61G 7/05784 5/733 |
| 2011/0107514 | A1* | 5/2011 | Brykalski | A61G 7/05769 5/652.1 |
| 2013/0047926 | A1* | 2/2013 | Simon | A01K 1/0353 119/28.5 |
| 2014/0033441 | A1 | 2/2014 | Morgan et al. | |
| 2014/0201909 | A1* | 7/2014 | Weyl | A61G 7/05715 5/423 |
| 2017/0164754 | A1* | 6/2017 | Alletto, Jr. | A47G 9/1036 |
| 2017/0208958 | A1* | 7/2017 | Alletto, Jr. | A47C 21/046 |
| 2018/0042393 | A1 | 2/2018 | Alletto et al. | |
| 2018/0242753 | A1* | 8/2018 | Ghanei | A47C 21/044 |
| 2019/0208918 | A1* | 7/2019 | DeFranks | A47C 27/18 |

* cited by examiner

BEDDING SYSTEM AND METHOD

TECHNICAL FIELD

The present disclosure generally relates to systems configured to create negative pressure and positive pressure to draw moisture and/or particles away from a sleeping surface of a mattress to provide a more pleasant sleeping experience. Methods of use are included.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Mattresses are an important aspect in achieving proper sleep. It is therefore beneficial to provide a mattress capable of drawing moisture and/or particles away from a sleeping surface of a mattress to provide a more pleasant sleeping experience. However, conventional mattresses fail to draw moisture and/or particles away from a sleeping surface of the mattress. This disclosure describes an improvement over these prior art technologies.

SUMMARY

In one embodiment, in accordance with the principles of the present disclosure, a bedding system is provided that includes a mattress having a sleep surface including a plurality of air transfer ports. An encasement encloses the sleep surface, the encasement comprising an air flow port. The air flow port is configured to be coupled to a pressure generator so that air that is drawn into the pressure generator is pulled into the air transfer ports or air that is forced into the encasement by the pressure generator is forced out of the air transfer ports.

In one embodiment, in accordance with the principles of the present disclosure, a bedding system comprises a mattress including a sleep surface comprising a breathable material. An encasement encloses the sleep surface and comprises an air flow port. The air flow port is configured to be coupled to a pressure generator so that air that is drawn into the pressure generator is pulled into the breathable material or air forced into the encasement by the pressure generator is forced out of the breathable material.

In one embodiment, in accordance with the principles of the present disclosure, a bedding system is provided that includes a mattress having a temperature sensor and a sleep surface comprising a plurality of air transfer ports. The mattress comprises a bottom surface opposite the sleep surface and a side wall that connects the surfaces, the side wall being free of ports, the sleep surface comprising a first material and the side wall comprising a second material that is less permeable than the first material. A porous encasement encloses the sleep surface, the encasement comprising an air flow port. A central vacuum system is coupled to the air flow port. The temperature sensor is configured to send a signal to the central vacuum system that causes the central vacuum system to create negative pressure so that air that is drawn into the central vacuum system is pulled into the air transfer ports or create positive pressure so that air that is forced into the encasement by the central vacuum system is forced out of the air transfer ports.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
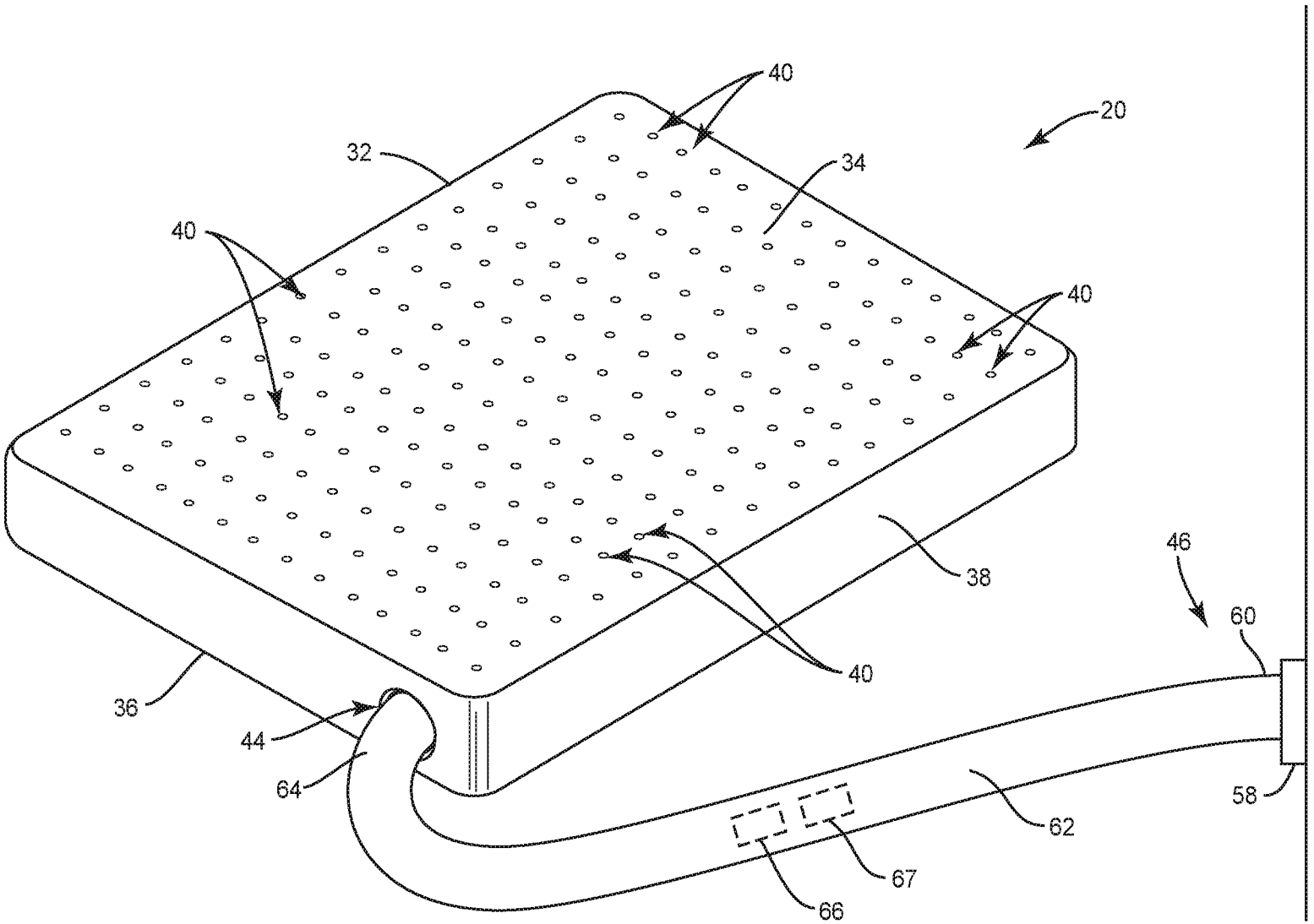
FIG. 1 is a perspective view of one embodiment of a bedding system in accordance with the principles of the present disclosure.

The exemplary embodiments of a bedding system and methods of use are discussed in terms of a bedding system that creates negative pressure so that air that is drawn into a pressure generator of the bedding system is pulled into air transfer ports on a sleep surface of a mattress of the bedding system, or create positive pressure so that air that is forced into an encasement of the bedding system by the pressure generator is forced out of the air transfer ports. The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of bedding system that creates negative pressure and/or positive pressure, related components and methods of using the bedding system in accordance with the principles of the present disclosure. Alternate embodiments are also disclosed. Reference will now be made in detail to the exemplary embodiments of the present disclosure, which are illustrated in the accompanying figures. Turning to FIGS. 1-10, there are illustrated components of a bedding system 20.

The components of bedding system 20 can be fabricated from materials including textiles, polymers and/or composites, depending on the particular application. For example, the components of bedding system 20, individually or collectively, can be fabricated from materials such as fabrics or textiles, paper or cardboard, cellulosic-based materials, biodegradable materials, plastics and other polymers, metals, semi-rigid and rigid materials. Various components of bedding system 20 may have material composites, including the above materials, to achieve various desired characteristics such as strength, rigidity, elasticity, performance and durability. The components of bedding system 20, individually or collectively, may also be fabricated from a heterogeneous material such as a combination of two or more of the above-described materials. The components of bedding system 20 can be woven, non-woven, knit, extruded, molded, injection molded, cast, pressed and/or machined. The components of bedding system 20 may be monolithically formed, integrally connected or include fastening elements and/or instruments, as described herein.

Bedding system 20 includes a mattress 22 comprising a sleep surface, such as, for example, a surface 24 having a plurality of spaced apart air transfer ports 26. Mattress 22 comprises a bottom surface 28 opposite surface 24 and a side wall 30 that connects surface 24 with surface 28. Wall 30 is free of ports. In some embodiments, ports 26 are uniformly spaced apart and each have a uniform size and/or shape. In some embodiments, ports 26 are uniformly spaced apart and have different sizes and/or shapes. In some embodiments, ports 26 are randomly spaced apart and each have a uniform size and/or shape. In some embodiments, ports 26 are randomly spaced apart and have different sizes and/or shapes. In some embodiments, ports 26 are pores that are inherently present in a material that forms surface 24. For example, in some embodiments surface 24 is formed from a fabric or fabric-like material that is made up of a plurality of woven or non-woven fibers or filaments that are arranged to form the fabric or fabric-like material. The fabric or fabric-like material will thus have gaps between adjacent fibers or filaments that define ports 26. In some embodiments, surface 24 is formed from a base material and holes are cut into the base material to form ports 26. In such embodiments, ports 26 are larger than any pores inherently present in a material that forms surface 24. For example, wherein the material that forms surface 24 is made up of a plurality of woven or non-woven fibers or filaments, the fibers or filaments are cut so that ports 26 each extend through one or more of the fibers or filaments. That is, each port 26 divides one or more of the fibers or filaments into a first portion and a second portion that is separated from the first portion by one of ports 26.

In some embodiments, surface 24 comprises a first material and wall 30 comprises a second material. In some embodiments, the second material and/or the first material includes polyester, wool, cotton, gortex, latex, silicone, breathable materials and non-breathable materials with holes punch therein to provide porosity. In some embodiments, the second material is different from the first material. In some embodiments, the second material is the same as the first material. In some embodiments, the second material that is less permeable than the first material in order to direct air in and/or surrounding mattress through surface 24 rather than wall 30, as discussed herein. In some embodiments, the first material has a first porosity and the second material has a second porosity that is less than the first porosity in order to direct air in and/or surrounding mattress through surface 24 rather than wall 30, as discussed herein. In some embodiments, wall 30 is non-porous. For example, in some embodiments, wall 30 is free of any cavities, openings, etc. such that wall 30 acts as an air barrier that prevents air from moving through wall 30. In some embodiments, surface 24 is at least about 25% more permeable than wall 30, at least about 50% more permeable than wall 30, at least about 75% more permeable than wall 30, at least about 100% more permeable than wall 30, at least about 150% more permeable than wall 30, at least about 200% more permeable than wall 30, at least about 300% more permeable than wall 30, at least about 400% more permeable than wall 30, or at least about more permeable than wall 30. In some embodiments, surface 24 has a porosity that is at least about 25% greater than the porosity of wall 30, at least about 50% greater than the porosity of wall 30, at least about 75% greater than the porosity of wall 30, at least about 100% greater than the porosity of wall 30, at least about 150% greater than the porosity of wall 30, at least about 200% greater than the porosity of wall 30, at least about 300% greater than the porosity of wall 30, at least about 400% greater than the porosity of wall 30, or at least about 500% greater than the porosity of wall 30. In some embodiments, surface 28 includes a third material that is the same or different than the first material. In some embodiments, surface 28 includes a third material that is the same or different than the second material.

System 20 includes an encasement 32 that encloses surface 24. In some embodiments, mattress 22 is enclosed entirely within encasement 32. Encasement 32 includes a top panel 34 that completely covers surface 24, an opposite bottom panel 36 that completely covers surface 28 and a side panel 38 that completely covers wall 30. At least a portion of panel 34 is porous and includes a plurality of spaced apart apertures 40 to provide porosity to panel 34. Apertures 40 are in communication with ports 26.

In some embodiments, apertures 40 are uniformly spaced apart and each have a uniform size and/or shape. In some embodiments, apertures 40 are uniformly spaced apart and have different sizes and/or shapes. In some embodiments, apertures 40 are randomly spaced apart and each have a uniform size and/or shape. In some embodiments, apertures 40 are randomly spaced apart and have different sizes and/or shapes. In some embodiments, apertures 40 are pores that are inherently present in a material that forms panel 34. For example, in some embodiments panel is formed from a fabric or fabric-like material that is made up of a plurality of woven or non-woven fibers or filaments that are arranged to form the fabric or fabric-like material. The fabric or fabric-like material will thus have gaps between adjacent fibers or filaments that define apertures 40. In some embodiments, panel 34 is formed from a base material and holes are cut into the base material to form apertures 40. In such embodiments, apertures 40 are larger than any pores inherently present in a material that forms panel 34. For example, wherein the material that forms panel 34 is made up of a plurality of woven or non-woven fibers or filaments, the fibers or filaments are cut so that apertures 40 each extend through one or more of the fibers or filaments. That is, each aperture 40 divides one or more of the fibers or filaments into a first portion and a second portion that is separated from the first portion by one of apertures 40. In some embodiments, panel 36 and/or panel 38 are non-porous. That is, panel 36 and/or panel 38 is free of any gaps or openings such that panel 36 and/or panel 38 act as an air barrier that reduces or eliminates airflow through panel 36 and/or panel 38. In some embodiments, panel 36 and/or panel 38 are porous. In such embodiments, panel 36 and/or panel 38 has a porosity that is less than a porosity of panel 34.

Figure 2:
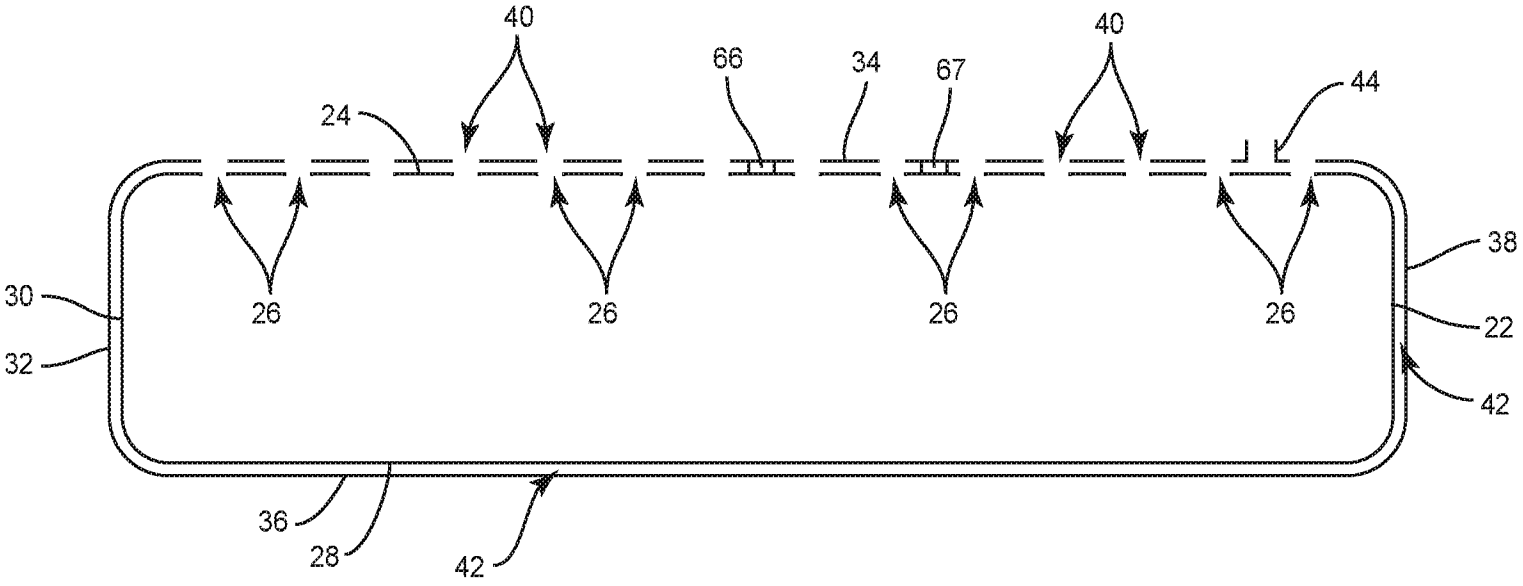
FIG. 2 is a cross sectional view of one embodiment of components of the system as shown in FIG. 1 in accordance with the principles of the present disclosure.
Figure 3:
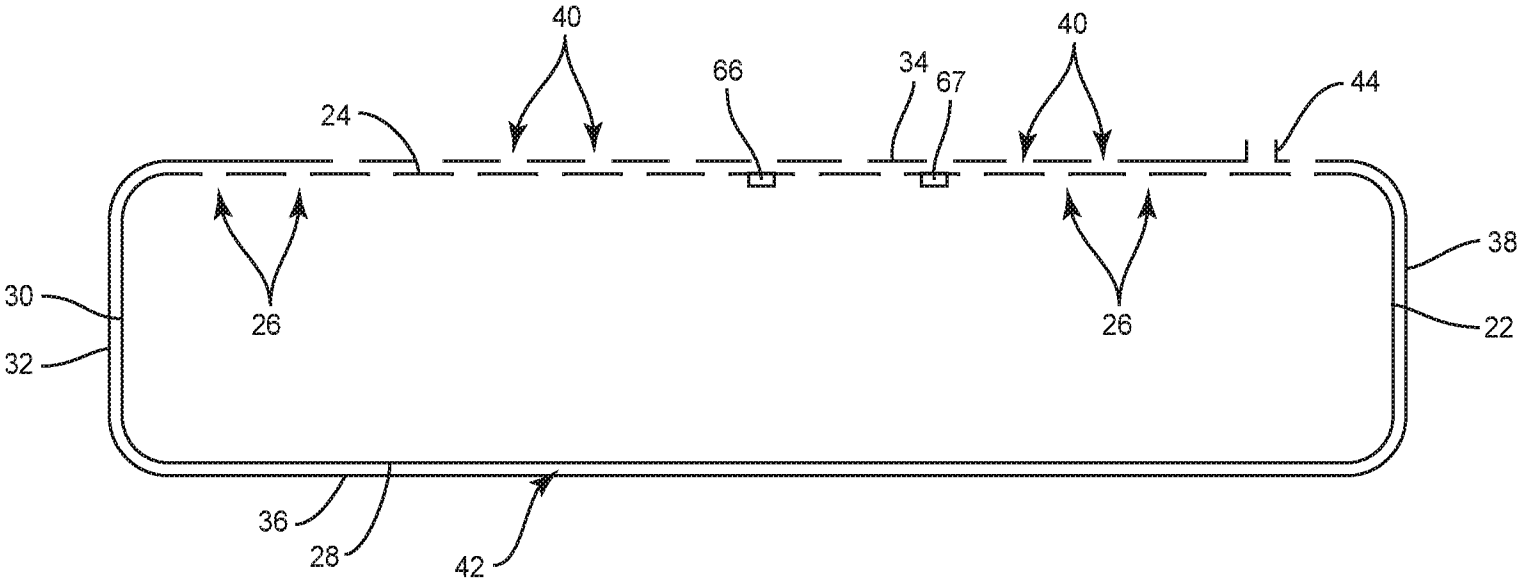
FIG. 3 is a cross sectional view of one embodiment of components of the system as shown in FIG. 1 in accordance with the principles of the present disclosure.
Figure 4:
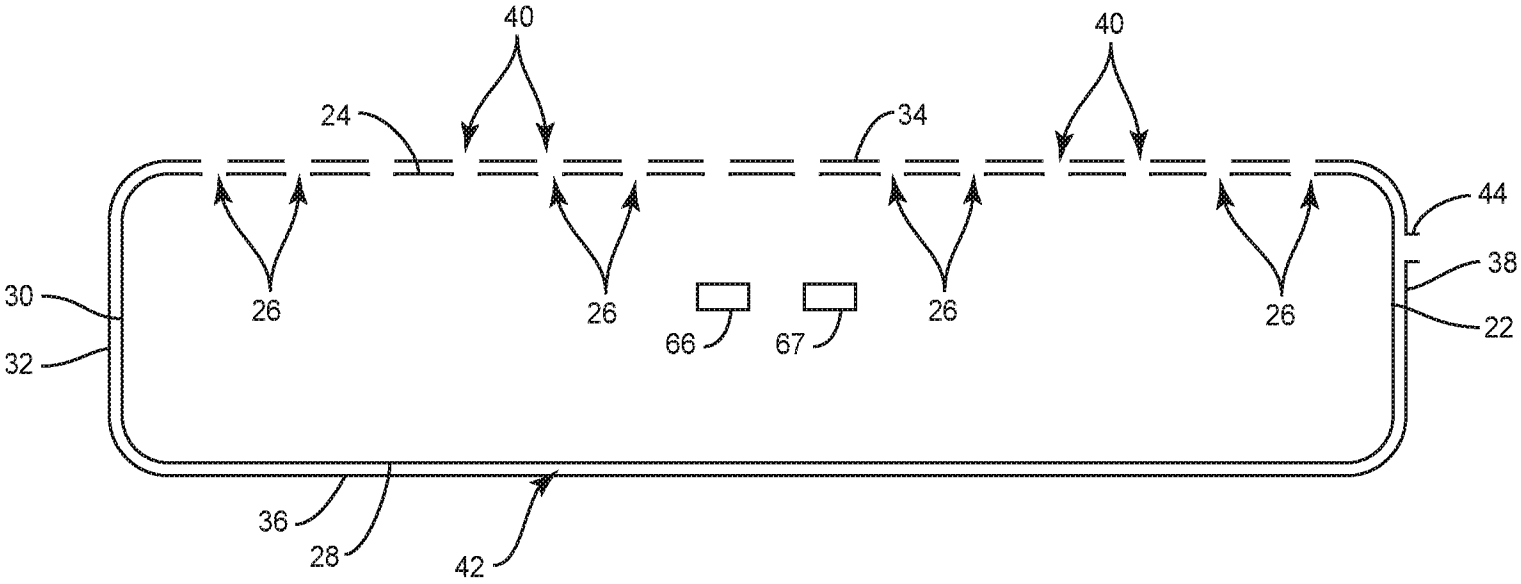
FIG. 4 is a cross sectional view of one embodiment of components of the system as shown in FIG. 1 in accordance with the principles of the present disclosure.
Figure 8:
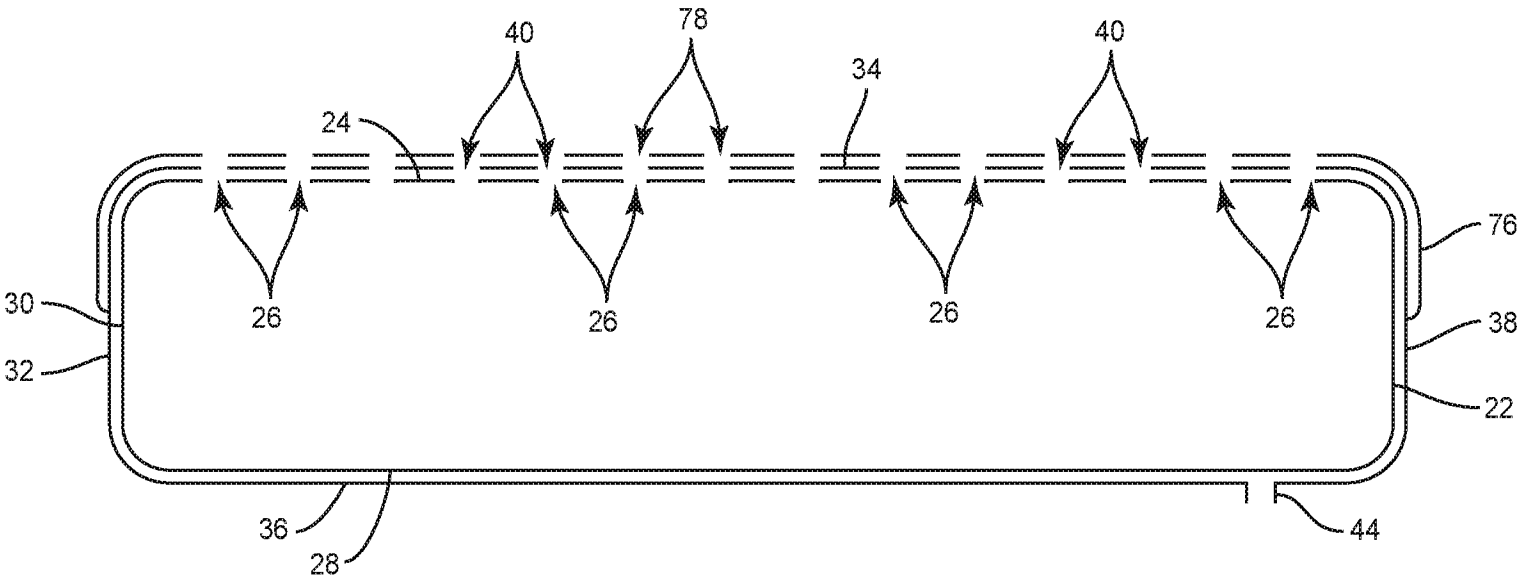
FIG. 8 is a cross sectional view of one embodiment of components of the system as shown in FIG. 1 in accordance with the principles of the present disclosure.

Inner surfaces of panels 34, 36, 38 define a cavity 42 that is communication with ports 26 and apertures 40. Mattress 22 is disposed in cavity 42 such that mattress 22 is completely enclosed within encasement 32. Enclosure 32 includes an air flow port 44 that is in communication with cavity 42. In some embodiments, port 44 is positioned in panel 34, as shown in FIGS. 2, 3, 6, 7, 9 and 10. In some embodiments, port 44 is positioned in panel 36, as shown in FIG. 8. In some embodiments, port 44 is positioned in panel 38, as shown in FIGS. 1 and 4. It is envisioned that encasement 32 can include only one or a plurality of ports 44. Port 44 is configured to be coupled to a pressure generator 46 so that air drawn into pressure generator 46 is pulled into ports 26, or air forced into encasement 32 by pressure generator 46 is forced out of ports 26. This allows pressure generator 46 to draw out moisture and/or particles away from surface 24 to provide a more pleasant sleeping experience, as discussed herein. In some embodiments, port 44 extends through a side wall of mattress 22 such that a hose that is connected with port 44 extends into a cavity of mattress 22 that includes fill material, such as, for example, springs and/or foam, as discussed herein.

In some embodiments, pressure generator 46 is incorporated into mattress 22 and/or encasement 32. In some embodiments, pressure generator 46 is a separate unit that is positioned outside of mattress 22 and/or encasement 32. In some embodiments, pressure generator 46 includes a vacuum cleaner. In some embodiments, pressure generator 46 includes a pump. In some embodiments, pressure generator 46 includes a central vacuum system 48. Central vacuum system 48 comprises a power unit 50, a pipe 52 having an end 54 that is connected to power unit 50 and an end 56 that is connected to an outlet 58. Outlet 58 is configured for disposal of an end 60 of a hose 62. An opposite end 64 of hose 62 is configured for disposal in port 44, as shown in FIG. 1. In some embodiments, end 64 is removably disposed in port 44. In some embodiments, end 64 is permanently and irremovably disposed in port 44. In some embodiments, at least one of pipe 52 and hose 62 is a tube, such, as for example a flexible tube. In some embodiments, bedding system 20 includes one or more caps or covers that cover any unused ports 44. That is, a cap or cover may be coupled to one or more of ports 44 that do not include end 64 disposed therein to prevent air from flowing in or out of cavity 42 through the unused ports 44.

Figure 6:
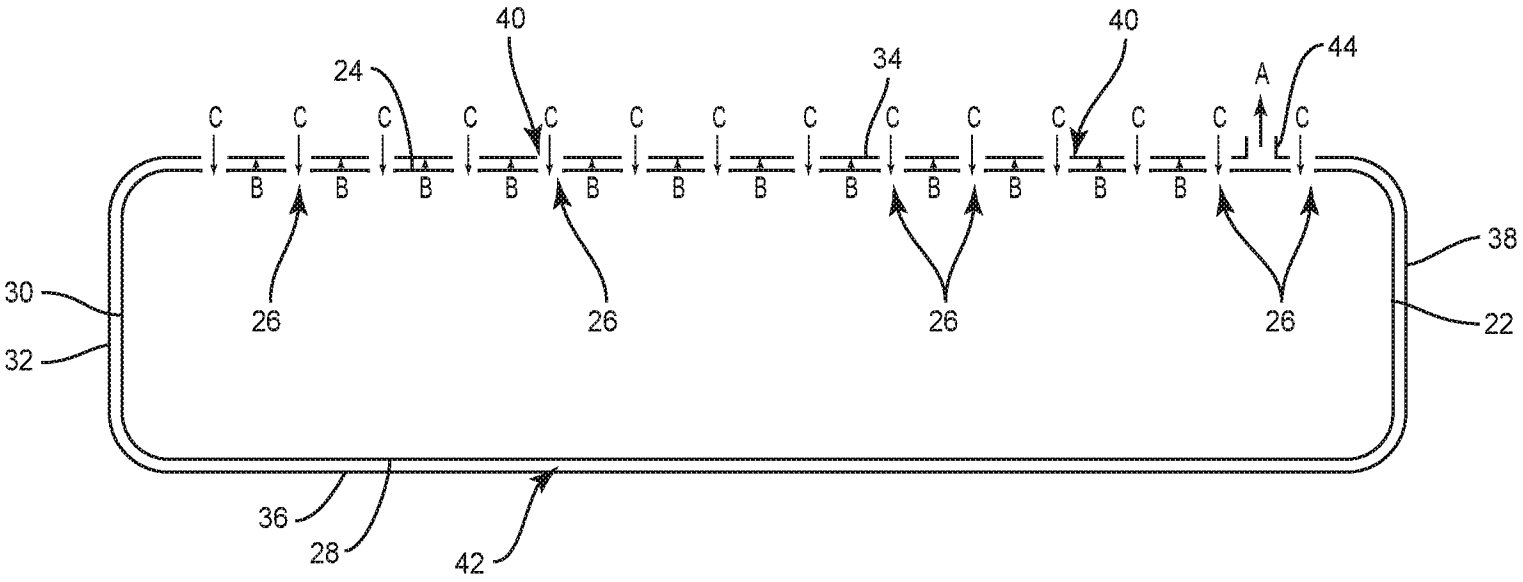
FIG. 6 is a cross sectional view of one embodiment of components of the system as shown in FIG. 1 in accordance with the principles of the present disclosure.
Figure 6A:
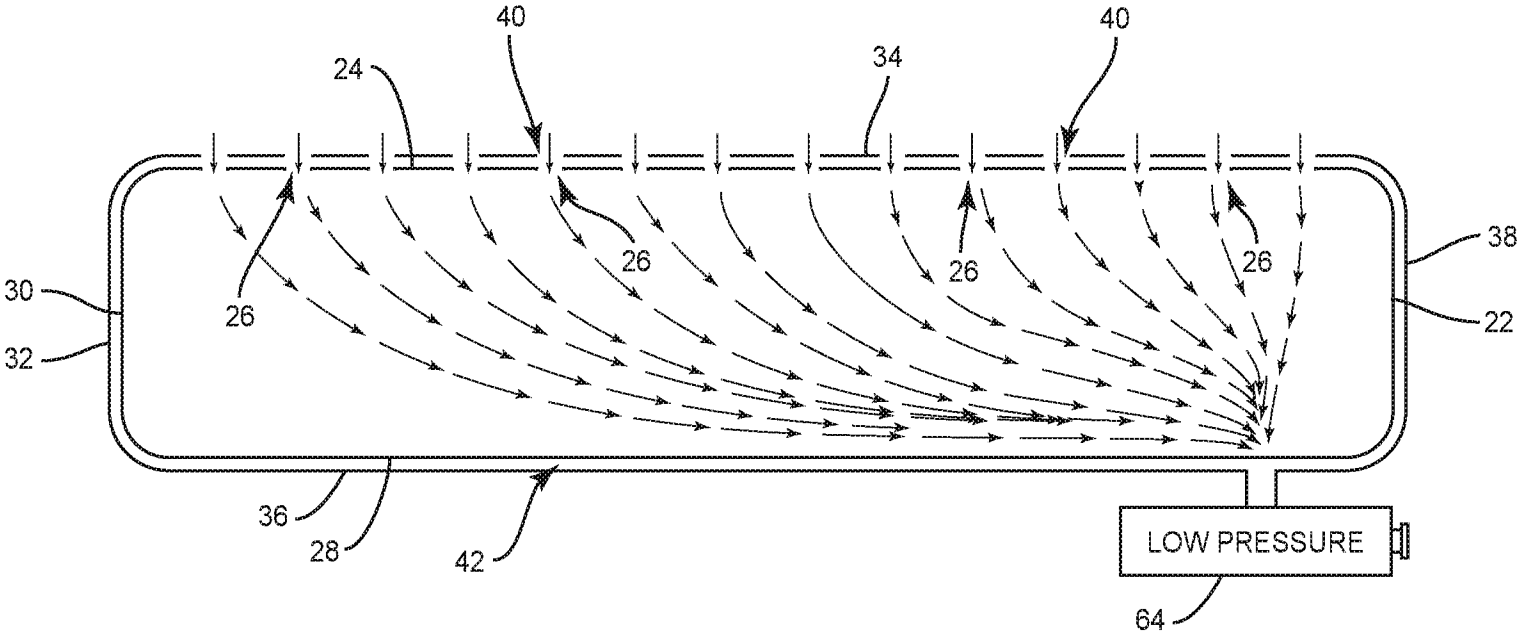
FIG. 6A is a cross sectional view of one embodiment of components of the system as shown in FIG. 1 in accordance with the principles of the present disclosure.
Figure 7:
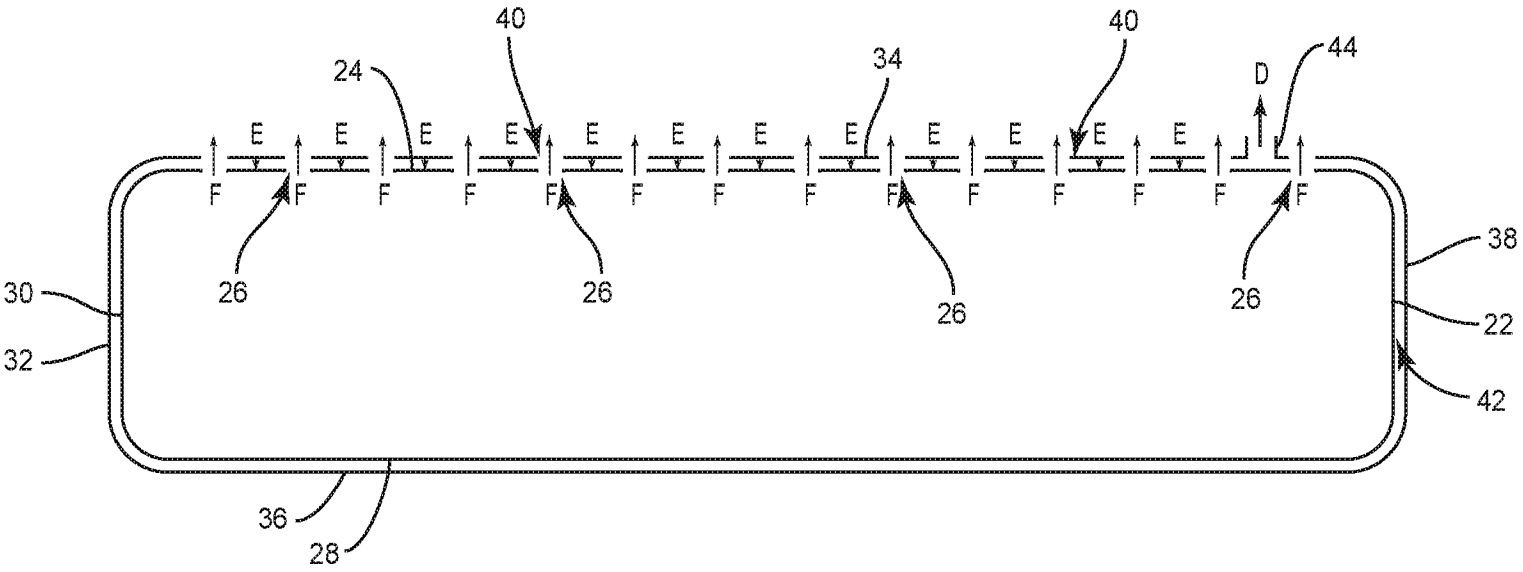
FIG. 7 is a cross sectional view of one embodiment of components of the system as shown in FIG. 1 in accordance with the principles of the present disclosure.

Power unit 50 includes a motor that is configured to create negative pressure, such as, for example, a vacuum when the motor is in an on position to provide suction within hose 62 to draw air, moisture and/or particles out of cavity 42, as discussed herein. In some embodiments, the motor is also configured to create positive pressure when the motor is in an on position to blow air, moisture and/or particles through hose 62 and into cavity 42, as discussed herein. For example, in some embodiments, the motor may create negative pressure when the motor is in a first position and can be reversed to create positive pressure, and vice versa. When the motor is turned from the on position to an off position, the negative pressure or the positive pressure is stopped. That is, power unit 50 is configured to create a vacuum that provides suction within hose 62 to draw air, moisture and/or particles out of cavity 42 and into pressure generator 46. As air, moisture and/or particles is drawn out of cavity 42 and into pressure generator 46, air is pulled into ports 26. For example, in some embodiments, pressure generator 46 draws air, moisture and/or particles out of cavity 42 in the direction shown by arrow A in FIG. 6 and into pressure generator 46, which causes panel 34 to move toward surface 24 in the direction shown by arrows B in FIG. 6. As panel 34 moves toward surface 24, ambient air is drawn through apertures 40 in the direction shown by arrows C in FIG. 6 and into ports 26. This allows cool air to be moved toward sleep surface 24, thus providing a cooling effect to sleep surface 24. For example, the temperature of sleep surface 24 may increase due to a person's body temperature, creating an uncomfortable sleep environment. Airflow through mattress 22 and encasement 32 is shown in FIG. 6A. As shown in FIG. 6A, ambient air is drawn through apertures 40 and ports 26 and into pressure generator 46 when pressure generator 46 creates negative pressure. The temperature of sleep surface 24 may be reduced by turning the motor of power unit 50 from the off position to the on position such that power unit 50 creates a vacuum that draws warm air away from sleep surface 24 and replaces the warm air with cooler air. In some embodiments, pressure generator 46 includes a fan, wherein the speed of the fan can be adjusted to provide different amounts of negative pressure. For example, the fan can be set to a low speed to generate a moderate amount of negative pressure. The fan can also be set to a higher speed to generate more negative pressure.

Alternatively, power unit 50 may be used to create positive pressure that blows air into cavity 42. As air is blown into cavity 42, air, moisture and/or particles in ports 26 is forced out of ports 26. For example, in some embodiments, pressure generator 46 creates positive pressure to blow air into cavity 42 in the direction shown by arrow D in FIG. 7, which causes surface 24 to move away from panel 34 in the direction shown by arrows E in FIG. 7. As surface 24 moves away from panel 34, air, moisture and/or particles in ports 26 is forced out of ports 26. The air follows the direction of the decrease in pressure. This allows warm air to be moved away from sleep surface 24, thus providing a cooling effect to sleep surface 24. For example, the temperature of sleep surface 24 may increase due to a person's body temperature, creating an uncomfortable sleep environment. The temperature of sleep surface 24 may be reduced by turning the motor of power unit 50 from the off position to the on position such that power unit 50 creates positive pressure that forces warm air out of ports 26. It is envisioned that the positive pressure created by pressure generator 46 may also be used to force moisture and/or particles out of ports 26. As such, system 20 may be used to effectively clean mattress 22. For example, system 20 may be used in the hospitality industry to remove moisture from mattresses daily. Indeed, when bedsheets are being changed by a chamber maid, he or she can turn power unit 50 on such that pressure generator 46 creates positive pressure that forces air, moisture and/or particles ports 26. In some embodiments, pressure generator 46 includes a fan, wherein the speed of the fan can be adjusted to provide different amounts of positive pressure. For example, the fan can be set to a low speed to generate a moderate amount of positive pressure. The fan can also be set to a higher speed to generate more positive pressure.

In some embodiments, power unit 50 comprises a sensor, such as, for example, a power sensor that is in configured to move the motor between the on and off positions. It is envisioned that bedding system 20 may include a remote control that communicates with the power sensor to turn the motor on and off. For example, should a sleeper desire to decrease the temperature of sleep surface 24, the sleeper can use the remote control to turn the motor of power unit 50 from the off position to the on position such that power unit 50 creates a vacuum that draws ambient air through apertures 40 and into ports 26 or creates positive pressure to force air, moisture and/or particles out of ports 26. When sleep surface 24 reaches a comfortable temperature, the sleeper can operate the remote control to turn the motor of power unit 50 from the on position to the off position to terminate any negative pressure or positive pressure. In some embodiments, the remote control is a smart phone. In some embodiments, the remote control is a tablet or computer. In some embodiments, the remote control is voice activated to allow a sleeper to turn the motor on and off using a voice command, thus eliminating the need to hold or otherwise touch the remote control.

In some embodiments, central vacuum system 48 comprises a temperature sensor configured to send a signal to the power sensor to move the motor from the off position to the on position when the temperature sensor detects a temperature above a threshold temperature. This allows power unit 50 to create a vacuum that draws ambient air through apertures 40 and into ports 26 or create positive pressure to force air, moisture and/or particles out of ports 26. In some embodiments, the temperature sensor is configured to send a signal to the power sensor to move the motor from the on position to the off position when the temperature sensor detects a temperature below a threshold temperature. This terminates any negative pressure or positive pressure. In some embodiments, the temperature sensor is part of a thermostat. That is, bedding system 20 may be integrated with an existing thermostat in a home or other building such that the thermostat sends a signal to the power sensor to move the motor from the off position to the on position when the thermostat detects a temperature above a threshold temperature. Likewise, the thermostat can send a signal to the power sensor to move the motor from the on position to the off position when the thermostat detects a temperature below a threshold temperature. This allows the motor of power unit 50 to be turned on and off automatically, based on the temperature in a room, as detected by the thermostat. It is envisioned that the thermostat can also function to regulate the temperature of one or more rooms within a building or other structure by turning an HVAC system on and off, for example.

Figure 9:
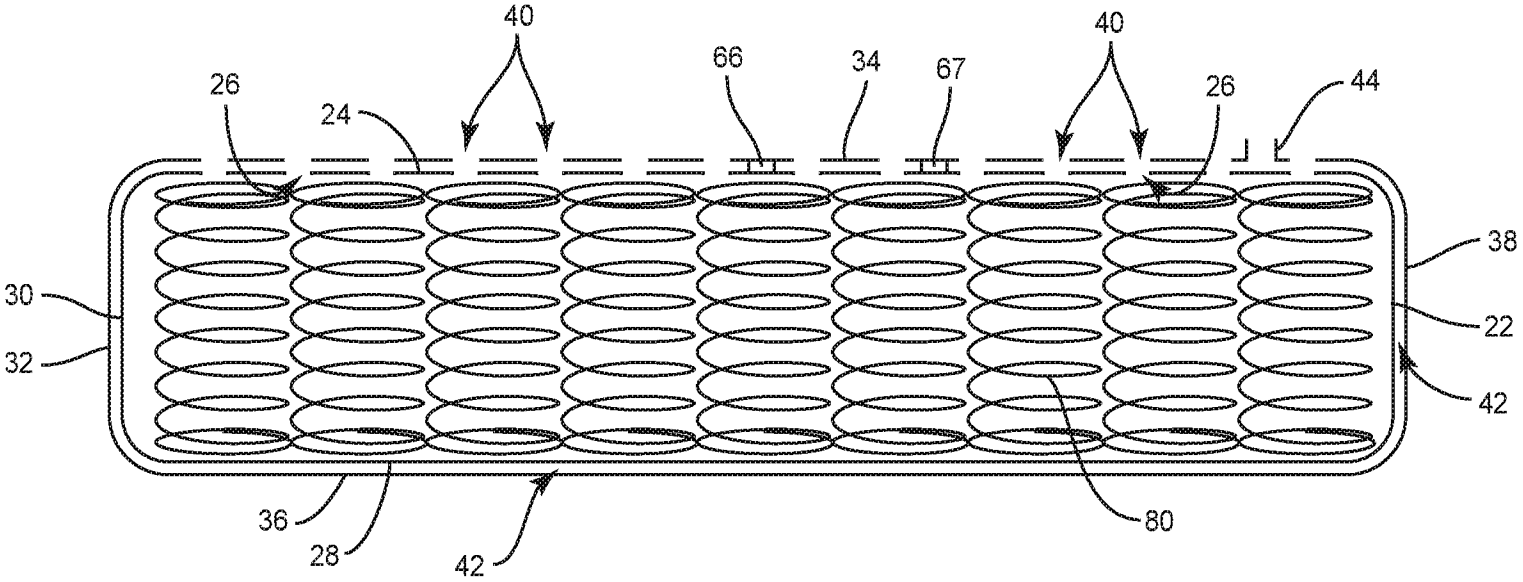
FIG. 9 is a cross sectional view of one embodiment of components of the system as shown in FIG. 1 in accordance with the principles of the present disclosure.
Figure 10:
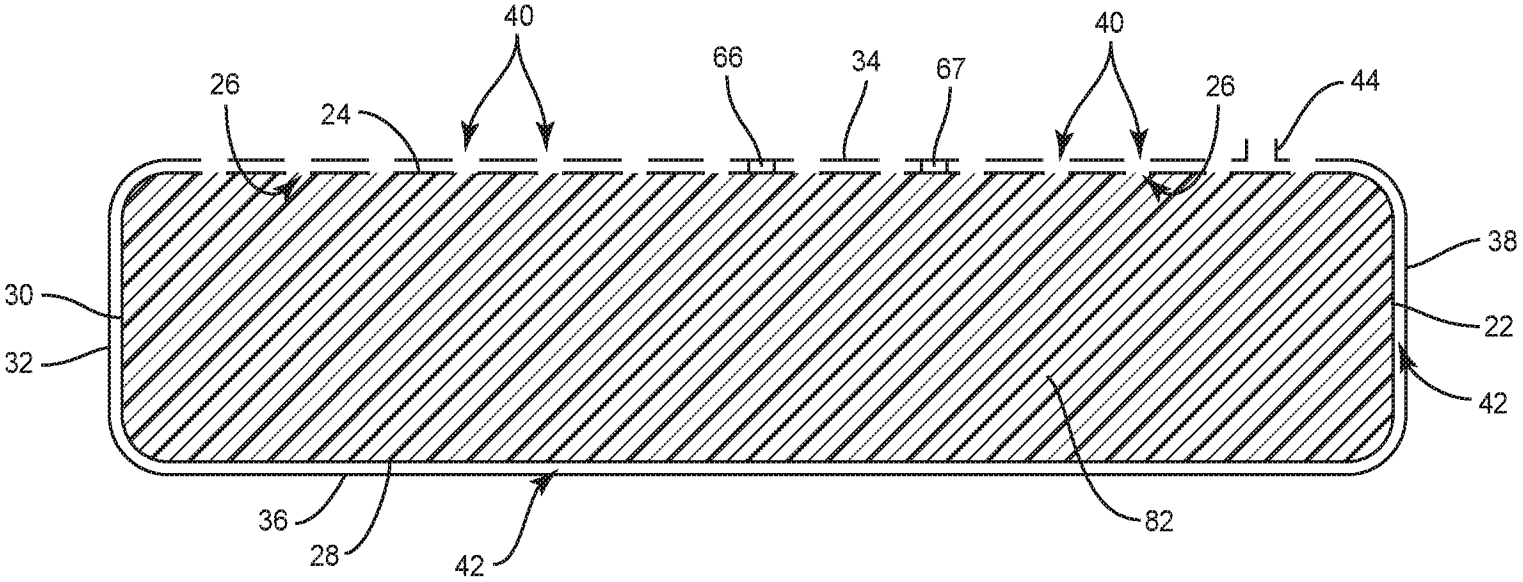
FIG. 10 is a cross sectional view of one embodiment of components of the system as shown in FIG. 1 in accordance with the principles of the present disclosure.

In some embodiments, mattress 22 comprises a temperature sensor 66 configured to send a signal to the power sensor to move the motor from the off position to the on position when temperature sensor 66 detects a temperature above a threshold temperature. This allows power unit 50 to create a vacuum that draws ambient air through apertures 40 and into ports 26 or create positive pressure to force air, moisture and/or particles out of ports 26. In some embodiments, temperature sensor 66 is positioned inside of hose 62, as shown in FIG. 1. In some embodiments, temperature sensor 66 is positioned between panel 34 and surface 24, as shown in FIG. 2. In some embodiments, temperature sensor 66 is positioned between surface 28 and surface 24, as shown in FIG. 3. In some embodiments, temperature sensor 66 is positioned within mattress 22, as shown in FIG. 4. For example, in some embodiments, temperature sensor 66 is positioned within a fill material positioned in mattress 22, as shown in FIGS. 9 and 10. In some embodiments, temperature sensor 66 is configured to send a signal to the power sensor to move the motor from the on position to the off position when temperature sensor 66 detects a temperature below a threshold temperature. This terminates any negative pressure or positive pressure.

In some embodiments, mattress 22 comprises a humidity sensor 67 configured to send a signal to the power sensor to move the motor from the off position to the on position when humidity sensor 67 detects a humidity above a threshold humidity. This allows power unit 50 to create a vacuum that draws ambient air through apertures 40 and into ports 26 or create positive pressure to force air, moisture and/or particles out of ports 26. In some embodiments, humidity sensor 67 is positioned inside of hose 62, as shown in FIG. 1. In some embodiments, humidity sensor 67 is positioned between panel 34 and surface 24, as shown in FIG. 2. In some embodiments, humidity sensor 67 is positioned between surface 28 and surface 24, as shown in FIG. 3. In some embodiments, humidity sensor 67 is positioned within mattress 22, as shown in FIG. 4. For example, in some embodiments, humidity sensor 67 is positioned within a fill material positioned in mattress 22, as shown in FIGS. 9 and 10. In some embodiments, humidity sensor 67 is configured to send a signal to the power sensor to move the motor from the on position to the off position when humidity sensor 67 detects a humidity below a threshold humidity. This terminates any negative pressure or positive pressure.

In some embodiments, hose 62 comprises a switch that is in communication with the motor of power unit 50. The switch is configured to move the motor between the on and off positions. For example, should a sleeper desire to decrease the temperature and/or humidity of sleep surface 24, the sleeper can operate the switch on hose 62 to turn the motor of power unit 50 from the off position to the on position such that power unit 50 creates a vacuum that draws ambient air through apertures 40 and into ports 26 or creates positive pressure to force air, moisture and/or particles out of ports 26. When sleep surface 24 reaches a comfortable temperature and/or humidity, the sleeper can operate the switch on hose 62 to turn the motor of power unit 50 from the on position to the off position to terminate any negative pressure or positive pressure.

Figure 5:
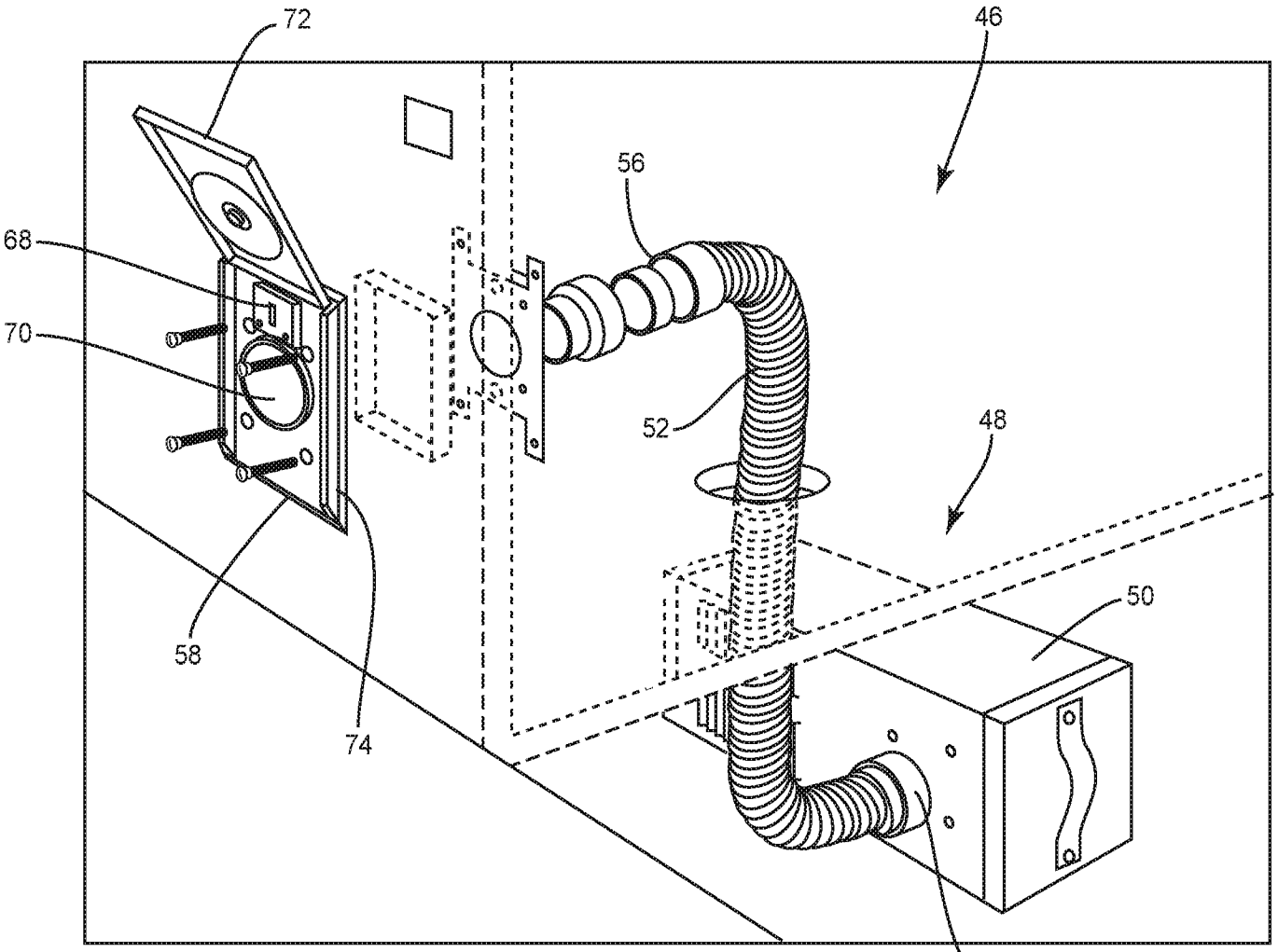
FIG. 5 is a perspective view, in part phantom, of components of the system shown in FIG. 1.

In one embodiment, outlet 58 includes a switch 68, as shown in FIG. 5. Switch 68 is configured to move a flap 70 between a first configuration in which flap 70 is closed and a second configuration in which flap 70 is open. When flap 70 is in the first configuration, hose 62 is devoid of any negative or positive pressure therein. When flap 70 is in the second configuration, any negative pressure or positive pressure created by power unit 50 is communicated into hose 62 to create a vacuum that draws ambient air through apertures 40 and into ports 26 or to create positive pressure to force air, moisture and/or particles out of ports 26. In some embodiments, flap 70 can be opened different amounts when flap 70 is in the second configuration. For example, flap 70 can be fully open or partially open when flap 70 is in the second configuration. It is envisioned that flap 70 may be regulated to have different degrees of being partially opened. This allows the user to regulate the amount of positive or negative pressure in hose 62. In one embodiment, switch 68 is in an extended orientation when flap 70 is in the second configuration and is in a depressed orientation when flap 70 is in the first configuration. In some embodiments, switch 68 is biased to the extended orientation such that the sleeper must move switch 68 from the depressed orientation to the extended orientation in order to move flap 70 from the first configuration to the second configuration. In some embodiments, switch 68 may be moved from the depressed orientation to the extended orientation by disengaging a cover 72 of outlet 58 from a body 74 of outlet 58. That is, cover 72 may be rotated relative to body 74 such that cover 72 no longer presses in on switch 68. In some embodiments, switch 68 may be moved from the extended orientation to the depressed orientation by rotating cover 72 relative to body 74 such that cover 72 engages switch 68 and presses switch 68 inwardly to the depressed orientation.

In some embodiments, switch 68 is configured to move the motor of power unit 50 from the off position to the on position such that power unit 50 creates a vacuum that draws ambient air through apertures 40 and into ports 26 or creates positive pressure to force air, moisture and/or particles out of ports 26. For example, switch 68 may be moved from the depressed orientation to the extended orientation by disengaging cover 72 of outlet 58 from body 74 of outlet 58 to move the motor of power unit 50 from the off position to the on position. That is, cover 72 may be rotated relative to body 74 such that cover 72 no longer presses in on switch 68. In some embodiments, switch 68 may be moved from the extended orientation to the depressed orientation by rotating cover 72 relative to body 74 such that cover engages switch 68 and presses switch 68 inwardly to the depressed orientation to move the motor of power unit 50 from the on position to the off position.

In some embodiments, system 20 includes a sheet 76 that is configured to cover panel 34, as shown in FIG. 8. Sheet 76 may include one or a plurality of openings 78 that are each in communication with one or more of apertures 40 and/or one or more of ports 26. In some embodiments, openings 78 are each aligned with one of apertures 40 and one of ports 26 such that sheet 76 does not restrict the movement of air, moisture and/or particles through apertures 40 and ports 26. In some embodiments, openings 78 are offset from apertures 40 and ports 26.

It is envisioned that mattress 22 may include a fill material. In some embodiments, mattress 22 is filled with a plurality of springs 80, as shown in FIG. 9. In some embodiments, one or more of springs 80 are enclosed within a pouch. In some embodiments, springs 80 are each positioned within a pocket, such as, for example, a fabric pocket. The pockets may be coupled to one another to form a string of pockets that each include one of springs 80 therein. In some embodiments, the string of pockets includes one or more slits between adjacent pockets to allow springs 80 to move independently of one another. In some embodiments, the string of pockets includes one or more slits that extend through a top surface of the string of pockets between adjacent pockets and/or one or more slits that extend through a bottom surface of the string of pockets between adjacent pockets. In some embodiments, mattress 22 includes a plurality of the strings of pockets.

In one embodiment, shown in FIG. 10, mattress 22 is filled with a foam, such as, for example, memory foam 82. However, it is envisioned that mattress 22 may be filled with other materials, such as, for example, cotton, kapok, flax, linen, jute, ramie, hemp, kenaf, bamboo, coir, sisal, silk, wool (sheep), alpaca, llama, goat (mohair, cashmere), rabbit (angora), camel, horse, yak, vicuna, qiviut, guanaco, rayon, azlon, lyocell, acetate, triacetate, rubber, polyester, olefin, nylon, acrylic, modacrylic, aramid, and spandex. Various components of mattress 22 may have material composites, including the above materials, to achieve various desired characteristics such as strength, rigidity, elasticity, compliance, mechanical performance, and durability. The components of mattress 22, individually or collectively, may also be fabricated from a heterogeneous material such as a combination of two or more of the above-described materials.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bedding system comprising:

a pressure generator;

a comfort layer including a sleep surface having a plurality of air transfer ports; and an encasement comprising opposite proximal and distal walls and a side wall connecting the proximal wall and the distal wall, the proximal wall defining a proximal most surface of the bedding system and the distal wall defining a distalmost surface of the bedding system, the side wall being made from a first material, the proximal wall being made from a second material such that the proximal wall is more permeable than the side wall to direct air though the air transfer ports, the encasement comprising an air flow port and a plurality of apertures, at least one of the apertures being directly aligned with one of the air transfer ports, the comfort layer being enclosed entirely within the encasement;

wherein a temperature sensor engages the sleep surface and is positioned between two of the air transfer ports such that the temperature sensor is spaced apart from each of the air transfer ports, wherein the air flow port is configured to be coupled to the pressure generator so that air that is drawn into the pressure generator is pulled into the air transfer ports or air that is forced into the encasement by the pressure generator is forced out of the air transfer ports, and wherein the temperature sensor is configured to send a signal to the pressure generator to create negative pressure if a temperature exceeds a selected threshold temperature so that air that is drawn into the pressure generator is pulled into the air transfer ports and to create positive pressure so that air forced into the encasement by the pressure generator is forced out of the air transfer ports.

2. A bedding system as recited in claim 1, wherein the encasement is porous.

3. A bedding system as recited in claim 1, wherein the sleep surface comprises a third material and the comfort layer comprises a lower surface opposite the sleep surface and a side surface extending from the sleep surface to the lower surface, the side surface and the lower surface each comprising a fourth material that is less permeable than the third material.

4. A bedding system as recited in claim 1, wherein the pressure generator is a central vacuum system.

5. A bedding system comprising:

a pressure generator;

a comfort layer including a sleep surface comprising a breathable material and a plurality of spaced apart air transfer ports each extending through the sleep surface; and an encasement comprising opposite proximal and distal walls and a side wall connecting the proximal wall and the distal wall, the proximal wall defining a proximalmost surface of the bedding system and the distal wall defining a distalmost surface of the bedding system, the side wall being made from a first material, the proximal wall being made from a second material such that the proximal wall is more permeable than the side wall to direct air though the air transfer ports, the encasement comprising an air flow port and a plurality of apertures, the apertures each being directly aligned with one of the air transfer ports, the comfort layer being enclosed entirely within the encasement;

wherein a temperature sensor engages the sleep surface and being is positioned between two of the air transfer ports such that the temperature sensor is spaced apart from each of the air transfer ports, wherein the air flow port is configured to be coupled to a pressure generator so that air that is drawn into the pressure generator is pulled into the breathable material or air forced into the encasement by the pressure generator is forced out of the breathable material, and wherein the temperature sensor is configured to send a signal to the pressure generator if a temperature exceeds a selected threshold temperature to create negative pressure so that air that is drawn into the pressure generator is pulled into the air transfer ports and to create positive pressure so that air forced into the encasement by the pressure generator is forced out of the air transfer ports.

6. A bedding system as recited in claim 5, wherein the encasement is porous.

7. A bedding system as recited in claim 1, further comprising a humidity sensor positioned within a port coupling, the humidity sensor being configured to send a second signal to the pressure generator to create negative pressure so that air that is drawn into the pressure generator is pulled into the air transfer ports and to create positive pressure so that air forced into the encasement by the pressure generator is forced out of the air transfer ports if a humidity exceeds a selected threshold humidity.

8. A bedding system as recited in claim 7, wherein the humidity sensor is spaced apart from the temperature sensor.

9. A bedding system as recited in claim 1, wherein the comfort layer comprises a lower surface opposite the sleep surface, the air flow port being positioned such that the air flow port is positioned closer to the lower surface than the sleep surface.

10. A bedding system as recited in claim 1, wherein the comfort layer includes a bottom surface opposite the sleep surface, the comfort layer including a side surface extending from the upper surface to the lower surface, the side surface being free of any openings extending therethrough.

11. A bedding system as recited in claim 1, wherein:

the comfort layer includes a bottom surface opposite the sleep surface, the comfort layer including a side surface extending from the upper surface to the lower surface; and wherein the proximal wall is positioned over the sleep surface, the proximal wall including the apertures, the distal and side walls each being free of any gaps or openings.

12. A bedding system as recited in claim 1, wherein the encasement includes only one air flow port.

13. A bedding system as recited in claim 1, wherein the apertures are uniformly spaced apart and each have a uniform size and shape.

14. A bedding system comprising:

a pressure generator;

a comfort layer including opposite top and bottom surfaces and a side surface extending from the bottom surface to the top surface, the bottom surface and the side surface each being free of any ports, the top surface defining a sleep surface having a plurality of air transfer ports extending therethrough; and an encasement comprising opposite proximal and distal walls and a side wall connecting the proximal wall and the distal wall, the proximal wall defining a proximalmost surface of the bedding system and the distal wall defining a distalmost surface of the bedding system, the side wall being made from a first material, the proximal wall being made from a second material such that the proximal wall is more permeable than the side wall to direct air though the air transfer ports, the encasement comprising an air flow port and a plurality of apertures, the apertures each being directly aligned with one of the air transfer ports, the comfort layer being enclosed entirely within the encasement;

wherein a temperature sensor engages the sleep surface and being is positioned between two of the air transfer ports such that the temperature sensor is spaced apart from each of the air transfer ports, wherein the pressure generator is coupled to the air flow port so that air that is drawn into the pressure generator is pulled into the air transfer ports or air that is forced into the encasement by the pressure generator is forced out of the air transfer ports, and wherein the temperature sensor is configured to send a signal to the pressure generator if a temperature exceeds a selected threshold temperature to create negative pressure so that air that is drawn into the pressure generator is pulled into the air transfer ports and to create positive pressure so that air forced into the encasement by the pressure generator is forced out of the air transfer ports.

* * * * *